US011104855B2

(12) United States Patent
Frey et al.

(10) Patent No.: US 11,104,855 B2
(45) Date of Patent: Aug. 31, 2021

(54) CO-PROCESSING OF LIGHT CYCLE OIL AND HEAVY NAPHTHA

(71) Applicant: UOP LLC, Des Plaines, IL (US)

(72) Inventors: Stanley Joseph Frey, Palatine, IL (US); Krishna Mani, Gurgaon (IN); Krishan Pratap Jadaun, Gurugram (IN); Gautam Pandey, Gurgaon (IN); Mousumi Chanda, Kolkata (IN)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 16/558,060

(22) Filed: Aug. 31, 2019

(65) Prior Publication Data

US 2021/0062099 A1 Mar. 4, 2021

(51) Int. Cl.
*C10G 65/12* (2006.01)
*C10G 69/10* (2006.01)

(52) U.S. Cl.
CPC ..... *C10G 65/12* (2013.01); *C10G 69/10* (2013.01); *C10G 2400/02* (2013.01); *C10G 2400/04* (2013.01); *C10G 2400/30* (2013.01)

(58) Field of Classification Search
CPC .... C10G 65/12; C10G 69/10; C10G 2400/04; C10G 2400/30; C10G 2400/02
USPC ..... 208/59, 73, 76, 105, 113
See application file for complete search history.

(56) References Cited

U.S. PATENT DOCUMENTS 7,601,254 B2 * 10/2009 Gosling ..... C10G 11/05 208/106
8,524,961 B2 * 9/2013 Haizmann ..... C10G 69/04 585/319
8,617,384 B2 12/2013 Haizmann
2017/0009156 A1 1/2017 Pelaez

OTHER PUBLICATIONS

Dukanovic, "Hydrotreating of straight-run gas oil blended with FCC naphtha and light cycle oil", "Fuel Processing Technology", Aug. 9, 2012, pp. 160-165, vol. 106, Publisher: Elsevier, Published in: Internet.

* cited by examiner

*Primary Examiner* — Thuan D Dang
(74) *Attorney, Agent, or Firm* — Paschall & Associates, LLC; James C. Paschall

(57) ABSTRACT

Processes for co-processing a naphtha stream with a light cycle oil stream are disclosed. The processes include hydrocracking the light cycle oil stream under hydrocracking conditions to provide a hydrocracked effluent stream. A naphtha stream is hydrotreated under hydrotreating conditions to provide a hydrotreated effluent stream. The hydrocracked effluent stream and the hydrotreated effluent stream may be passed to a stripping column to recover a stripping bottom stream. The stripping bottom stream may be passed to a main fractionation column to recover an intermediate naphtha stream.

9 Claims, 5 Drawing Sheets

CO-PROCESSING OF LIGHT CYCLE OIL AND HEAVY NAPHTHA

FIELD

The field relates to an improved light cycle oil (LCO) hydrocracking processes for aromatics production. More particularly, the field relates to improvement of LCO hydrocracking by co-processing naphtha stream with LCO feed.

BACKGROUND

Aromatics, particularly benzene, toluene, ethylbenzene, and the xylenes (ortho, meta, and para isomers), which are commonly referred to as "BTEX" or more simply "BTX," are extremely useful chemicals in the petrochemical industry. They represent the building blocks for materials such as polystyrene, styrene-butadiene rubber, polyethylene terephthalate, polyester, phthalic anhydride, solvents, polyurethane, benzoic acid, and numerous other components. Conventionally, BTX is obtained for the petrochemical industry by separation and processing of fossil-fuel petroleum fractions, for example, in catalytic reforming or cracking refinery process units, followed by BTX recovery units.

Currently, there is an increasing emphasis on using FCC technology to upgrade high boiling hydrocarbons. With more FCC units coming on stream, utilizing LCO which is rich in multi-ring aromatics has become challenging. LCO is a byproduct of the FCC process that offers a distinct opportunity for refiners to expand production of BTX and other high-value aromatics. Hydrocracking of LCO produces an aromatics-rich gasoline stream. In some refineries configured for petrochemical production, it may be desirable to carry out additional processing to maximize the yield of valuable xylenes from the aromatic gasoline produced in the LCO hydrocracker.

Today, refiners are treating the FCC heavy naphtha and blending it in the gasoline fuel pool. However, complete routing of highly aromatic FCC naphtha to a gasoline pool is not possible for many refiners due to regulatory limits on aromatic content; i.e., 35% volume max. The heavy naphtha fraction and LCO are taken as separate streams from an FCC main fractionation column. Naphtha is taken as gasoline fuel product which is degraded by LCO which boils in the higher diesel fuel range. Moreover, refiners have been reluctant to process naphtha in a hydrocracking unit due to the belief that naphtha would crack down to lighter, less valuable LPG and dry gas.

There is a continuing need for an improved, cost-effective LCO hydrocracking process that enables the production of aromatics and enables refineries to engage in petrochemical production.

SUMMARY

We have found an improved process for LCO hydrocracking that simply co-processes a naphtha stream with an LCO feed in a hydroprocessing reactor. The process comprises hydrocracking the LCO stream under hydrocracking conditions to provide a hydrocracked effluent stream and hydrotreating the naphtha stream under hydrotreating conditions to provide a hydrotreated effluent stream. The hydrocracked effluent stream and the hydrotreated effluent stream are passed to a main fractionation column to recover a desired naphtha product. The naphtha stream is charged to any location of the hydroprocessing reactor. The heavy naphtha produced in this co-processing process has a high concentration of aromatic compounds.

These and other features, aspects, and advantages of the present disclosure are further explained by the following detailed description, drawings and appended claims.

Figure 1:
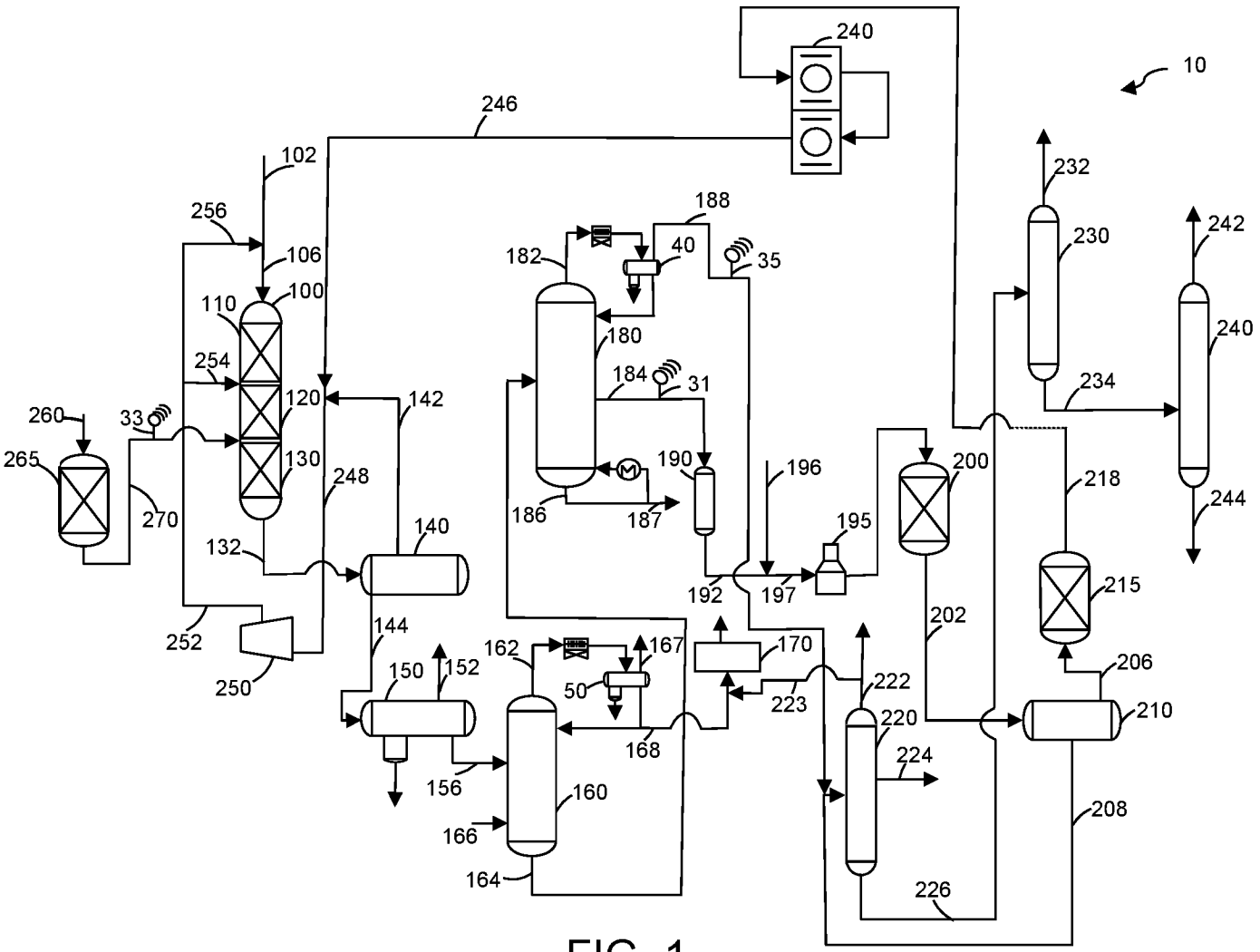
FIG. 1 is a schematic representation of LCO hydrocracking using the process of the present disclosure.

Skilled artisans will appreciate that elements in the drawings are illustrated for simplicity and clarity and have not necessarily been drawn to scale. For example, the dimensions of some of the elements in the drawings may be exaggerated relative to other elements to help improve understanding of various embodiments of the present disclosure. Also, common but well-understood elements that are useful or necessary in a commercially feasible embodiment may not be depicted in order to facilitate a less obstructed view of these various embodiments of the present disclosure.

Definitions

The following detailed description is merely exemplary in nature and is not intended to limit the application and uses of the embodiment described. Furthermore, there is no intention to be bound by any theory presented in the preceding background or the following detailed description.

The term "communication" means that material flow is operatively permitted between enumerated components.

The term "downstream communication" means that at least a portion of material flowing to the subject in downstream communication may operatively flow from the object with which it communicates.

The term "upstream communication" means that at least a portion of the material flowing from the subject in upstream communication may operatively flow to the object with which it communicates.

The term "direct communication" means that flow from the upstream component enters the downstream component without undergoing a compositional change due to physical fractionation or chemical conversion.

The term "bypass" means that the object is out of downstream communication with a bypassing subject at least to the extent of bypassing.

As used herein, the term "TX" means the temperature at which X volume percent of the sample boils using ASTM D-86. As an example, the abbreviation "T5" or "T95" means the temperature at which 5 volume percent or 95 volume percent, as the case may be, respectively, of the sample boils using ASTM D-86.

As used herein, the term "True Boiling Point" (TBP) means a test method for determining the boiling point of a material which corresponds to ASTM D-2892 for the production of a liquefied gas, distillate fractions, and residuum of standardized quality on which analytical data can be obtained, and the determination of yields of the above fractions by both mass and volume from which a graph of temperature versus mass % or liquid volume % distilled is produced using fifteen theoretical plates in a column with a 5:1 reflux ratio.

As used herein, the term "initial boiling point" (IBP) means the temperature at which the sample begins to boil using ASTM D-86.

As used herein, the term "final boiling point" (FBP) means the temperature at which the sample has all boiled off using ASTM D-7169, ASTM D-86 or TBP, as the case may be.

The term "liquefied petroleum gas" or "LPG" refers to a mixture of low-boiling hydrocarbons that exists in a liquid state at ambient temperatures when under moderate pressures which are less than about 1.5 MPa and which comprises principally propane, propylene and butane.

As used herein, the term "stream" can include various hydrocarbon molecules, such as straight-chain, branched, or cyclic alkanes, alkenes, alkadienes, and alkynes, and optionally other substances, such as gases, e.g., hydrogen, or impurities, such as heavy metals, and sulfur and nitrogen compounds. The stream can also include aromatic and non-aromatic hydrocarbons. Moreover, the hydrocarbon molecules may be abbreviated $C_1$, $C_2$, $C_3$ . . . $C_n$ where "n" represents the number of carbon atoms in the one or more hydrocarbon molecules. Furthermore, a superscript "+" or "−" may be used with an abbreviated one or more hydrocarbons notation; e.g., $C_{3+}$ or $C_{3-}$, which is inclusive of the abbreviated one or more hydrocarbons. As an example, the abbreviation "$C_3$+" means one or more hydrocarbon molecules of three carbon atoms and/or more. In addition, the term "stream" may be applicable to other fluids, such as aqueous and non-aqueous solutions of alkaline or basic compounds, such as sodium hydroxide.

The term "column" means a distillation column or columns for separating one or more components of different volatilities. Unless otherwise indicated, each column includes a condenser on an overhead of the column to condense and reflux a portion of an overhead stream back to the top of the column and a reboiler at a bottom of the column to vaporize and send a portion of a bottom stream back to the bottom of the column. Feeds to the columns may be preheated. The top pressure is the pressure of the overhead vapor at the outlet of the column. The bottom temperature is the liquid bottom outlet temperature. Overhead lines and bottom lines refer to the net lines from the column downstream of the reflux or reboil to the column. Alternatively, a stripping stream may be used for heat input near the bottom of the column.

As used herein, the term "rich" can mean that the outlet stream has a greater concentration of the indicated component than in the inlet stream to a vessel.

As used herein, the term "separator" means a vessel which has an inlet and at least an overhead vapor outlet and a bottoms liquid outlet and may also have an aqueous stream outlet from a boot. A flash drum is a type of separator which may be in downstream communication with a separator which latter may be operated at higher pressure.

As used herein, the term "N+2A" is taken as an index of reforming, wherein 'N' denotes percentage of naphthenes and 'A' denotes the percentage of mono-aromatics. "N+2A" is calculated as the volume percent of naphthenes in the naphtha plus 2 multiplied by the volume of mono-aromatics.

As used herein, the term "cut point" of a material means the temperature at which the T95 of the material and a T5 of a heavier material are the same.

DETAILED DESCRIPTION

The processes described herein are particularly useful for production of valuable aromatic compounds, low sulfur diesel products, gasoline products, and/or other hydrocarbon products from a light cycle oil (LCO) stream and a naphtha stream. A naphtha stream as used herein may be a heavy naphtha stream comprising $C_{10-}$ hydrocarbons. The naphtha stream used may be a catalytically cracked naphtha stream comprising at least 50 wt % of cyclic hydrocarbons. A suitable naphtha stream can be obtained from fluid catalytic cracking (FCC) because they contain large proportions of cyclics. The cyclic hydrocarbons are well suited for production of petrochemicals.

The naphtha stream may have a T5 between about 80° C. (176° F.) and 150° C. (302° F.), a T95 between about 160° C. (320° F.) and about 220° C. (428° F.). The LCO stream is a by-product of fluid catalytic cracking (FCC) processes. LCO is an economical and advantageous feedstock as it typically is not considered a finished product and contains significant quantities of sulfur, nitrogen and polynuclear aromatic compounds. The LCO stream may have a T5 in the range of about 213° C. (416° F.) to about 244° C. (471° F.) and a T95 in the range of about 354° C. (669° F.) to about 400° C. (752° F.).

Conventionally, refiners would not charge naphtha to a hydrocracking reactor for concern that the naphtha fraction, if processed under hydrocracking conditions might get cracked. However, upon experimenting, the Applicants have found that naphtha does not crack when processed with LCO in a hydrocracking reactor and is subjected to only olefin saturation when processed in a hydrocracking reactor due to the presence of cyclohexane and other naphthenic ring compounds in the naphtha. It is known that the higher ring compounds are difficult to hydrocrack. Therefore, we have found that it is feasible to process a heavy naphtha fraction under hydrocracking conditions with LCO. Experiments have shown only a slight conversion of only 0.7-1 wt % of heavy naphtha to lighter compounds boiling below the naphtha range. The naphtha stream charged to the hydroprocessing reactor may be used as a quench medium to lower the rise in temperature of reactants in the hydroprocessing reactor. Moreover, the naphtha fraction is hydrotreated, thus reducing its concentration of organic sulfur and nitrogen. Since, the naphtha fraction does not crack and undergoes only olefin saturation, the intermediate naphtha product produced from co-processing the LCO stream and the naphtha stream is rich in cyclic compounds such as naphthenes and aromatics. Further, the applicants have found that the overall hydrogen consumption is also reduced when the LCO stream and the naphtha stream are co-processed together. The calculation of total hydrogen consumed is performed on the basis of LCO present in the total feed. When a LCO stream is co-processed with naphtha, the percentage of LCO in the feed is reduced compared to hydroprocessing only an LCO stream and thus results in a lower proportional hydrogen consumption.

Processes for producing aromatics from a LCO stream and a naphtha stream have been developed. An example of an integrated process 10 is shown in the FIG. 1 which includes an integrated hydrotreating and hydrocracking step, a stripping step, a fractionation step, a dehydrogenation step, and various aromatic recovery steps. As shown in the figures, the integrated process and apparatus 10 includes a hydroprocessing reactor 100, a diolefin saturation reactor 265, a hydrotreating bed 110, a hydrocracking bed 120, and a post-treatment bed 130, a stripping column 160, a main fractionation column 180, a dehydrogenation reactor 200, a benzene column 220, a toluene column 230, and a xylene column 240.

As shown in the FIG. 1, a LCO stream in a line 102 is admixed with a hydrogen stream in a line 256. The resulting admixture in line a 106 is contacted with a hydrotreating catalyst in the hydrotreating bed 110 operating under hydrotreating conditions.

The term "hydrotreating" as used herein refers to processes wherein a hydrogen-containing treat gas is used in the presence of suitable catalysts which are primarily active for the removal of heteroatoms, such as sulfur, nitrogen, oxygen and metals from the hydrocarbon feedstock. In hydrotreating, hydrocarbons with double and triple bonds such as olefins may be saturated. Aromatics may also be saturated. Some hydrotreating processes are specifically designed to saturate aromatics.

Suitable hydrotreating catalysts for use in treating the LCO stream may be any known conventional hydrotreating catalyst and may include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable hydrotreating catalysts include zeolitic catalysts, as well as noble metal catalysts where the noble metal may be selected from palladium and platinum. It is within the scope of the present disclosure that more than one type of hydrotreating catalyst may be used in the same reaction vessel. The Group VIII metal may typically be present in an amount ranging from about 2 to about 20 wt %, preferably from about 4 to about 12 wt %. The Group VI metal may typically be present in an amount ranging from about 1 to about 25 wt %, preferably from about 2 to about 25 wt %.

Typical hydrotreating temperatures may range from about 204° C. (400° F.) to about 482° C. (900° F.) with pressures from about 3.5 MPa (500 psig) to about 17.3 MPa (2500 psig), preferably from about 3.5 MPa (500 psig) to about 13.9 MPa (2000 psig). A liquid hourly space velocity of feedstock from about 0.1 to about 10 hr-1 may be used with a hydrotreating catalyst or a combination of hydrotreating catalysts.

A hydrotreated effluent stream withdrawn from the hydrotreating bed 110 is contacted with a hydrocracking catalyst in the hydrocracking bed 120 operating under hydrocracking conditions. The hydrocracking bed 120 is in downstream communication with the hydrotreating bed 110. The hydrocracking bed 120 may contain one or more beds of the same or different catalyst. In one aspect, the preferred hydrocracking catalysts may utilize amorphous bases or low-level zeolite bases combined with one or more Group VIII or Group VIB metal hydrogenation components. In another aspect, the hydrocracking catalyst may be selected from Y and Beta zeolite catalysts with Ni—Mo and Ni—W. In still another aspect, the hydrocracking bed may contain a hydrocracking catalyst which comprises, in general, any crystalline zeolite cracking base upon which may be deposited a minor proportion of a Group VIII metal hydrogenating component. Additional hydrogenation components may be selected from Group VIB for incorporation with the zeolite base.

The hydrocracking process may be conducted in the presence of hydrogen and preferably at hydrocracking reactor conditions which include a temperature from about 232° C. (450° F.) to about 468° C. (875° F.), a pressure from about 3.5 MPa (500 psig) to about 20.8 MPa (3000 psig), a liquid hourly space velocity (LHSV) from about 0.1 to about 30 $hr^{-1}$, and a hydrogen circulation rate from about 84 normal m3/m3 (500 standard cubic feet per barrel) to about 4200 m3/m3 (25,000 standard cubic feet per barrel). Alternatively, the hydrotreated effluent stream may be combined with hydrogen and heated prior to being introduced into the hydrocracking bed. The hydrotreated effluent stream may be admixed with a hydrogen stream in a line 254 prior to or during contact with the hydrocracking catalyst. A combined recycle hydrogen gas stream in a line 252 may be divided into the hydrogen stream in the line 254 and a hydrogen stream in the line 256.

A hydrocracked effluent stream is withdrawn from the hydrocracking bed 120. The hydrocracked effluent stream from the hydrocracking bed 120 may be introduced into the post-treatment bed 130 operating under hydrotreating conditions to remove sulfur, nitrogen and other contaminants thereof. The post-treatment bed 130 and the hydrotreating bed 110 may contain same or different catalyst and operating conditions. The post-treatment bed 130 may be in downstream communication with the hydrocracking bed 120.

A naphtha stream in a line 260 may be charged to a diolefin saturation reactor 265 to reduce diolefin content before passing the naphtha stream to the post-treatment bed 130. The diolefin saturation reactor 265 is operated at relatively low temperature of 160-200° C. Use of the diolefin saturation reactor 265 can prevent fouling of the pre-heating equipment and pressure drop buildup. The diolefin saturation reactor 265 can include any suitable catalyst, such as a metal hydrogenation component of groups 8-10 of the periodic table supported on a refractory inorganic oxide support. Typically, the support can be alumina, but other inorganic oxides can be utilized such as non-zeolitic molecular sieves. The hydrogenation metal can include cobalt, nickel, or molybdenum. Usually, the diolefin saturation reactor 265 includes a fixed bed of catalyst operated in a downflow mode in a liquid phase at a pressure of about 2,400 to about 4,200 kPa. A treated naphtha stream in a line 270 is withdrawn from the diolefin saturation reactor 265.

The treated naphtha stream in the line 270 is passed to the post-treatment bed 130. The ratio of the LCO stream in the line 102 and the naphtha stream in the line 270 used in this process may vary from 1:0.05 to 1:2.5. The treated naphtha stream in the line 270 passed to the post-treatment bed 130 and used as a quench medium to lower the inlet temperature of the effluent from hydrocracking bed 120. This eliminates the need for an additional quench stream. Moreover, addition of the naphtha stream to the post-treatment bed 130 also results in a hydrotreated product rich in cyclic compounds such as naphthenes and aromatics. Further, the applicants have also found that the overall hydrogen consumption is also reduced when the LCO stream and the naphtha stream are co-processed together.

Further, a post-treated effluent stream in a line 132 is withdrawn from the post-treatment bed and passed to a first separator 140. The first separator 140 may be a high-pressure separator. The high-pressure separator is generally operated at a temperature from about 20° C. (68° F.) to about 100° C. (212° F.). The high-pressure separator 140 may be operated at pressures between about 3.5 MPa (gauge) (500 psig) and about 20.8 MPa (gauge) (3000 psig). The high-pressure separator 140 is in downstream communication with post-treatment bed 130. The high-pressure separator may produce a vaporous stream comprising hydrogen, hydrogen sulfide, and ammonia.

A hydrogen-rich gas stream in a line 142 and a liquid hydrocarbonaceous stream containing naphtha in a line 144 is withdrawn from the high-pressure separator 140. The hydrogen-rich gas stream in the line 142 normally provides majority of the total hydrogen in the combined recycle hydrogen gas stream in the line 252, with the hydrogen consumed in the hydrotreating bed 110 and the hydrocracking bed 120 being replaced by a fresh make-up hydrogen stream in a line 196.

The liquid hydrocarbonaceous stream in the line 144 is flashed in a flash drum 150 and sent to the stripping column 160. Light gases in a line 152 may be removed in the flash drum. A sour water stream may also be collected from a boot of the separator 150. The liquid hydrocarbonaceous stream in the line 156 withdrawn from the flash drum 150 is stripped in the stripping column 160 using a stripping medium in a line 166 to provide a $C_4$ and lighter hydrocarbons, such as propane and butane as a stripping column overhead stream in a line 162. A stripping medium such as steam, air, inert gases, and hydrocarbon gases may be used in the stripping column. The stripping column overhead stream in the line 162 may be condensed and separated in a receiver 50. A stripping column net overhead stream in a line 167 from the receiver 50 carries a net stripper off gas of LPG, dry gas, hydrogen sulfide and hydrogen. Unstabilized light naphtha from the bottoms of the receiver 50 may be split between a reflux portion refluxed to the top of the stripping column 160 and a liquid stripping column overhead stream in a line 168 for further recovery or processing of light naphtha to a LPG recovery unit 170. A sour water stream may be collected from a boot of the overhead receiver 50. A stripped stream is removed from the stripping column as a stripping bottom stream in a line 164.

The stripping column 160 is in downstream communication with the hydrocracking bed 120. The stripping column 160 may be operated with a bottoms temperature between about 160° C. (320° F.) and about 360° C. (680° F.) and an overhead pressure of about of about 0.7 MPa (gauge) (100 psig), preferably no less than about 0.34 MPa (gauge) (50 psig), to no more than about 2.0 MPa (gauge) (290 psig). The temperature in the overhead receiver 50 ranges from about 38° C. (100° F.) to about 66° C. (150° F.) and the pressure is essentially the same as in the overhead of the stripping column 160.

Subsequently, the stripping bottom stream in the line 164 is passed to the main fractionation column 180. The top pressure in the fractionation column 180 ranges between about 100 and about 500 kPa and the bottom temperature in the fractionation column ranges between about 200° C. and about 350° C. The main fractionation column 180 is in downstream communication with stripping column 160. A hydrocarbon stream containing ultra-low sulfur diesel in a line 186 is removed from the main fractionation column 180 and a portion is reboiled and returned to the main fractionation column 180 while a net hydrocarbon stream is taken in a line 187 containing ultra-low sulfur diesel. Another hydrocarbon stream containing $C_{5+}$ gasoline in a line 182 is removed from the main fractionation column 180. The hydrocarbon stream containing $C_{5+}$ gasoline in the line 182 may be condensed and separated in a receiver 40 with a portion of the condensed liquid being refluxed back to the main fractionation column 180. A net hydrocarbon stream containing $C_{5+}$ gasoline in a line 188 from the receiver 40 is sent to the benzene column 220. Still another hydrocarbon stream containing intermediate naphtha product stream in a line 184 may be removed from a side of the main fractionation column 180. The main fractionation column is in downstream communication with stripping column 160.

The intermediate naphtha product in the line 184 may be passed through a sulfur guard 190 to remove sulfur contaminants. The intermediate naphtha product in a line 192 withdrawn from the sulfur guard 190 may be admixed with the fresh make-up hydrogen stream in the line 196 and the combined stream in a line 197 may be passed to the dehydrogenation reactor 200. The combined stream in the line 197 may be heated in a charge heater 195 before passing to the dehydrogenation reactor 200. In the dehydrogenation reactor 200, the naphtha product stream is dehydrogenated to produce aromatics from naphthenes to produce a dehydrogenated naphtha stream in a line 202 comprising olefinic and aromatic compounds. In the dehydrogenation reactor 200, naphthenes, such as cyclohexane, are converted to aromatics including benzene, toluene and xylene. The dehydrogenation catalyst typically includes a first component platinum-group metal, a second component modifier metal, and a third component inorganic-oxide support, which is typically a high purity alumina. Typically, the platinum-group metal is in the range of about 0.01 to about 2.0 wt % and the modifier metal component is in the range of about 0.01 to about 5 wt %, each based on the weight of the finished catalyst. The platinum-group metal is selected from platinum, palladium, rhodium, ruthenium, osmium, and iridium. The preferred platinum-group metal component is platinum. The metal modifiers may include rhenium, tin, germanium, lead, cobalt, nickel, indium, gallium, zinc, uranium, dysprosium, thallium, and mixtures thereof. Suitable dehydrogenation catalysts are taught in U.S. Pat. No. 5,665,223. Typical dehydrogenation conditions include a liquid hourly space velocity from about 1.0 to about 5.0 $hr^{-1}$, a ratio of hydrogen to hydrocarbon from about 1 to about 10 moles of hydrogen per mole of hydrocarbon feed entering the dehydrogenation reactor 200, and a pressure from about 2.5 to about 35 $kg/cm^{-1}$.

The dehydrogenated naphtha stream in the line 202 is passed to a second separator 210. The second separator is operating at a pressure of 1.0 to 2.8 MPa. In the second separator 210, hydrogen produced in the dehydrogenation reactor 200 is separated from an aromatics-rich stream in a line 208. A hydrogen-rich gas is recovered as an overhead stream in a line 206.

The hydrogen-rich gas in the line 206 is passed to a pressure swing adsorption bed 215 to remove tail gases and recover a high purity hydrogen gas in a line 218. Pressure swing adsorption (PSA) separates a multi-component gas stream containing at least two gases having different adsorption characteristics. In PSA, a multi-component gas is typically fed to at least one of a plurality of adsorption zones at an elevated pressure effective to adsorb at least one component, while at least one other component passes through. At a defined time, feed to the PSA is terminated and the bed is depressurized by one or more co-current depressurization steps wherein pressure is reduced to a predetermined level which permits the separated, less-strongly adsorbed component or components remaining in the bed to be drawn off without significant concentration of the more-strongly adsorbed components.

A suitable hydrogen stream fed to the above-mentioned hydrocracking bed 120 and hydrotreating bed 130 would be any stream containing hydrogen at purity greater than about 90 wt %, preferably greater than 99 wt %, such as the high purity hydrogen gas in the line 218 from the PSA bed 215. The high purity hydrogen gas in the line 218 recovered from the PSA bed 215 is introduced into a make-up compressor 240. The make-up compressor 240 may comprise a two-stage compressor, where the hydrogen enters the first stage compressor followed by the second stage compressor, before being introduced into the hydrotreating bed 120 and the hydrocracking bed 130.

The hydrogen-rich gas stream in the line 142 from the top of the high-pressure separator 140 may preferably be amine treated to remove hydrogen sulfide and water washed (not shown in Figures) to remove ammonia. The amine treated and water washed hydrogen-rich gas may be combined with a hydrogen gas in a line 246 from the makeup compressor. A combined hydrogen gas in a line 248 may be sent to a hydrocracking bed recycle gas compressor 250 which then may send the combined recycle hydrogen gas stream in the line 252 to the hydrotreating bed 120 and the hydrocracking bed 130.

The aromatics-rich stream in the line 208 withdrawn from the second separator 210 is further processed using various know steps to recover xylene and other aromatic products. The configuration of these steps varies with the feedstock quality and the desired product slate. A number of process steps that may be used in aromatics recovery include, but are not limited to, separating aromatics-rich stream into a benzene-rich stream and a stream of toluene and heavier hydrocarbons; extracting benzene from the benzene-enriched stream; separating the toluene and heavier hydrocarbon enriched stream to produce a toluene-enriched stream and a xylenes-plus-enriched stream.

The aromatics-rich stream in the line 208 and the net hydrocarbon stream containing $C_{5+}$ gasoline in the line 188 may be passed to the benzene column 220. The top pressure in the benzene column 220 ranges between 50 kPa to 500 kPa and the bottom temperature in the benzene column ranges between 140° C. to 240° C. Benzene, having a lower boiling point than toluene, is removed in a line 224 from a side of the benzene column as a benzene product stream. A stream having a lower boiling point than benzene, containing $C_{5-}$ compounds, is recovered in a line 222, a portion of which in a line 223 is combined with liquid stripping column overhead stream in the line 168 and passed to the LPG recovery unit 170. A liquid stream containing $C_{7+}$ aromatic compounds in a line 226 is removed from the benzene column bottoms and passed to the toluene column 230. The liquid stream in the line 226 includes toluene, having a higher boiling point than benzene, and heavier aromatic hydrocarbons such as various xylene isomers.

In the toluene column 230, toluene is separated from heavier components; i.e., components having a higher boiling point than toluene, and is removed as overhead stream in a line 232. The top pressure in the toluene column 230 ranges between 50 kPa to 500 kPa and the bottom temperature in the toluene column ranges between 140° C. to 240° C. The heavier aromatic hydrocarbons are removed as a bottom stream in a line 234. A bottoms stream in the line 234, including a mixture of xylenes, exits the toluene column 230 and is fed to the xylene column 240.

In xylene column 240, xylene is separated from heavier components, i.e., components having higher boiling points than xylene, and is removed as overhead stream in a line 242. The top pressure in the xylene column 240 ranges between 50 kPa to 500 kPa and the bottom temperature in the xylene column ranges between 150° C. to 270° C. The heavier aromatic hydrocarbons comprising $C_{9+}$ hydrocarbons are removed as a bottoms stream in a line 244. In another embodiment, the toluene column 230 and the xylene column 240 can be combined into a dividing wall column.

Figure 2:
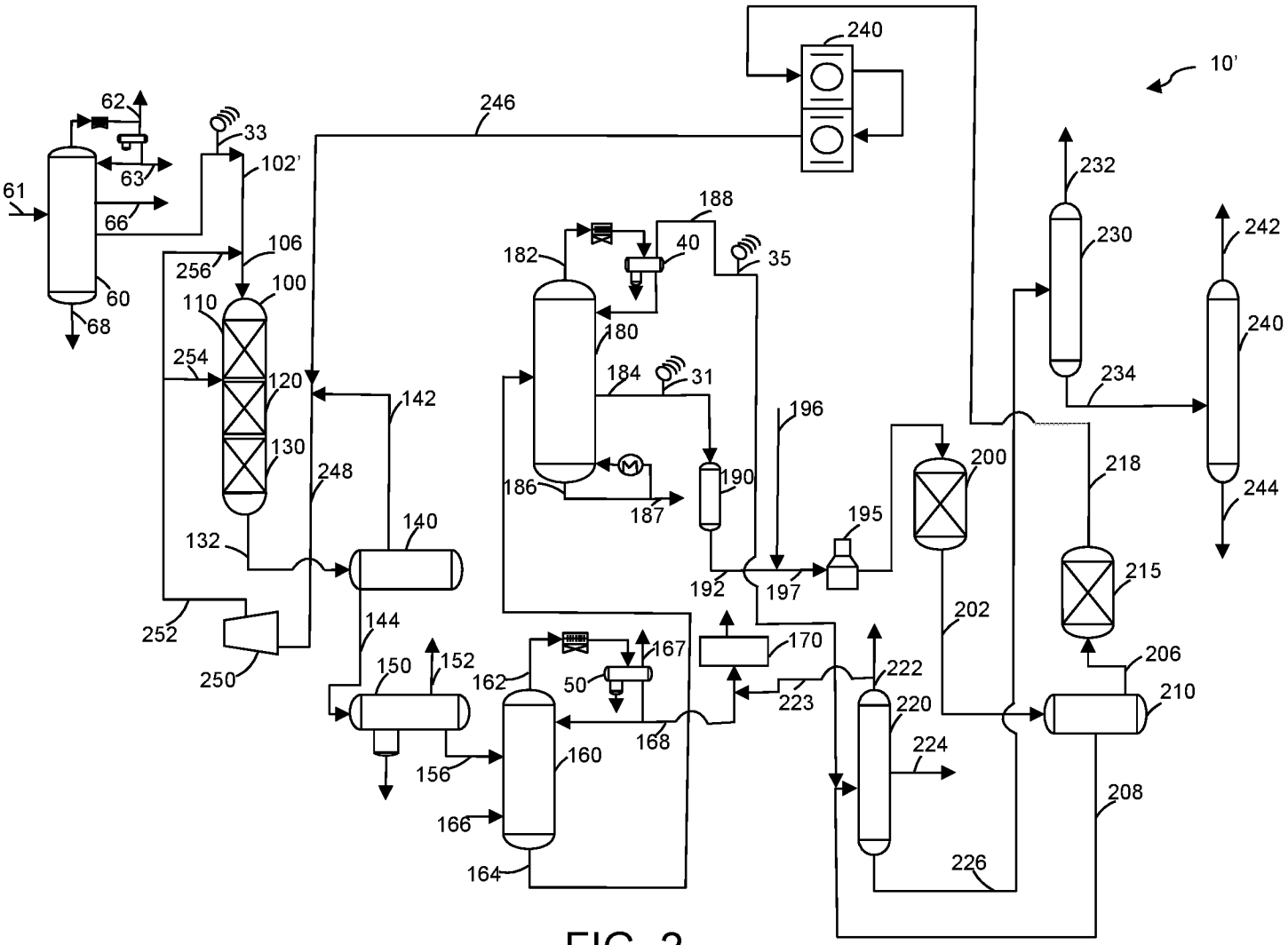
FIG. 2 is an alternative schematic representation of LCO hydrocracking using the process of the present disclosure.
Figure 3:
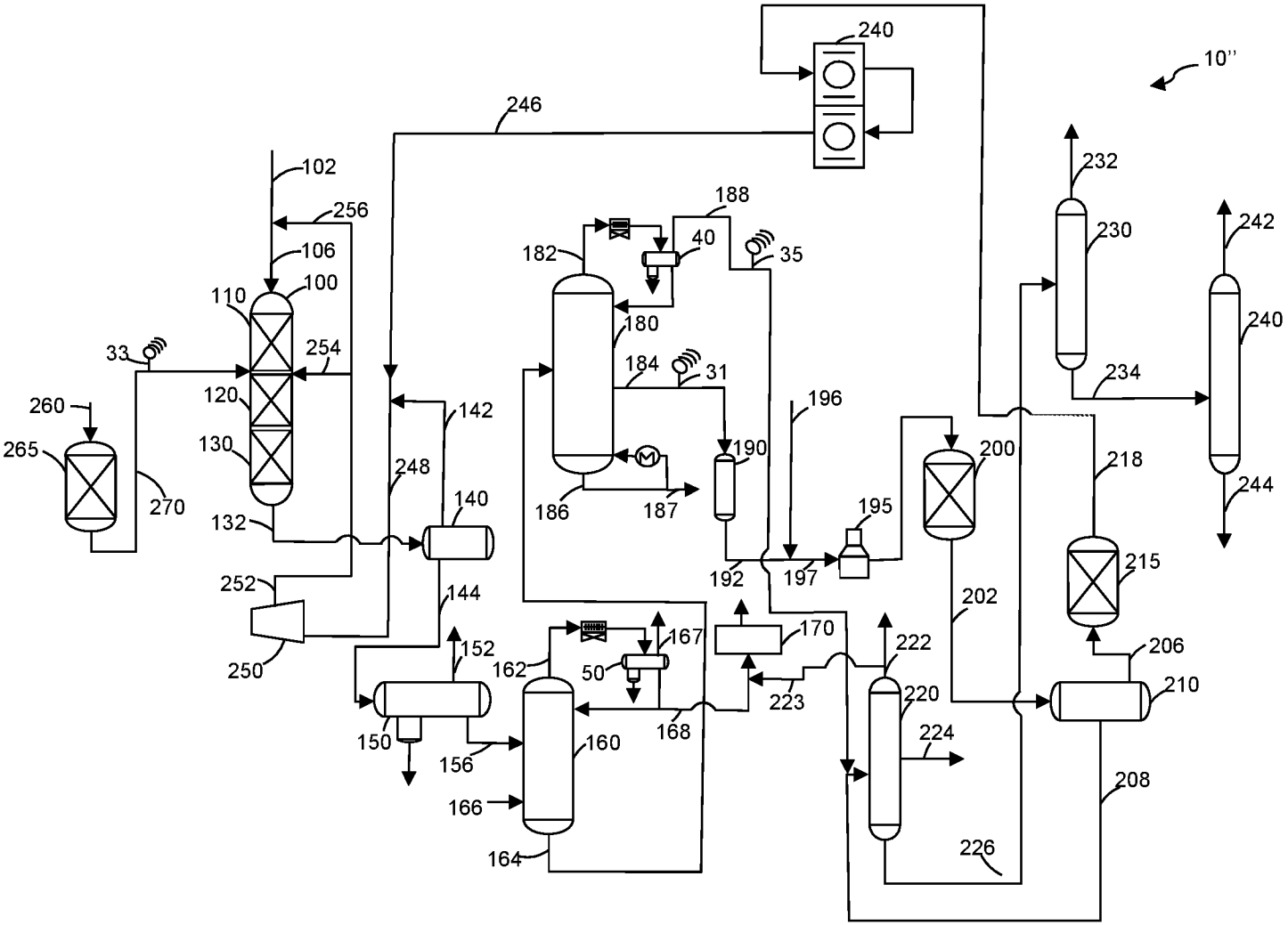
FIG. 3 is an alternative schematic representation of LCO hydrocracking using the process of the present disclosure.

In FIG. 2 and FIG. 3 elements with the same configuration as in FIG. 1 will have the same reference numeral as in FIG. 1. Elements in FIG. 2 which have a different configuration as the corresponding element in FIG. 1 will have the same reference numeral but designated with a prime symbol (').

Elements in FIG. 3 which have a different configuration as the corresponding element in FIG. 1 will have the same reference numeral but designated with a double prime symbol (").

Turning to FIG. 2, the overall flow scheme 10' is similar to that of FIG. 1, however in FIG. 2, a combined stream comprising LCO and naphtha is added to the hydroprocessing reactor 100 rather than adding naphtha stream separately. The cut point of the LCO feed to be obtained from a fluid catalytic cracking (FCC) main fractionation column 60 is changed to a T5 between 80° C. (176° F.) and 150° C. (302° F.) and a T95 in the range of about 354° C. (669° F.) to about 400° C. (752° F.) so that a combined stream in a line 102' comprising LCO and heavy naphtha is recovered. The other product streams from the FCC main fractionation column 60 may include a net fractionated overhead stream comprising LPG in a net overhead line 63, a light naphtha stream in a line 66 from a side cut outlet. An unconverted oil stream may be provided in a bottoms line 68. The combined stream in the line 102' comprising LCO as well as naphtha is passed to the hydrotreating bed 110. Subsequently, the hydrotreated effluent stream is then passed to be the hydrocracking bed 120 to produce a hydrocracked effluent stream. The hydrocracked effluent stream withdrawn from the hydrocracking bed 120 is introduced into the post-treatment bed 130. In FIG. 2, the combined stream in the line 102' comprising LCO and naphtha is obtained and passed to the hydrotreating bed 110 which is in upstream communication with the hydrocracking bed 120, as opposed to FIG. 1, wherein LCO stream is passed to the hydrotreating bed 110 and the treated naphtha stream 270 is passed to the post-treatment bed 130 which is located downstream of the hydrocracking bed 120. In another embodiment, instead of recovering a combined stream comprising LCO and naphtha from the FCC main fractionation column 60, a separate naphtha stream can be added into the LCO stream before passing to the hydrotreating bed 110. The naphtha stream may pass through the diolefin saturation reactor 265.

Conventionally, refiners remove a separate naphtha fraction and a separate LCO fraction from main fractionation column of an FCC process. A stream taken at a cut point with a T5 between about 80° C. (176° F.) and 150° C. (302° F.) and a T95 in the range of about 354° C. (669° F.) to about 400° C. (752° F.) will include LCO as well as a heavy naphtha. In an aspect, the stream may have a T50 between about 93° C. (200° F.) and about 149° C. (300° F.). This way product recovery from the FCC fractionator is simplified. This will eliminate the operation involved for obtaining a separate naphtha stream and a separate LCO stream.

Now turning to FIG. 3, the overall flow scheme 10" is similar to that of FIG. 1, however in FIG. 3, the treated naphtha stream in a line 270" bypasses the first hydrotreating bed 110 and is first passed to the hydrocracking bed 120. The LCO stream in the line 102 is hydrotreated in the hydrotreating bed 110 which is in upstream communication with the hydrocracking bed 120. The hydrotreated effluent stream and the treated naphtha stream in the line 270" are passed to the hydrocracking bed 120 to produce a hydrocracked effluent stream. The hydrocracked effluent stream is then passed to the post-treatment bed 130. In FIG. 3, the treated naphtha stream in the line 270" is passed to the hydrocracking bed 120, as opposed to FIG. 1, where the treated naphtha stream in the line 270 is passed directly to the post-treatment bed 130. In FIG. 3, the treated naphtha stream in the line 270" may be passed to the hydrocracking bed 120 at many possible locations. The treated naphtha stream in the line 270" may be passed to the top of the hydrocracking bed 120 or any intermediate location of the hydrocracking bed. The treated naphtha stream in the line 270" passed to the hydrocracking bed 120 is used as a quench medium to lower the temperature of the effluent from the hydrocracking bed 120. This eliminates the need for an additional quench stream. Since, the naphtha fraction does not crack and undergoes only olefin saturation, the product resulting from the co-processing of the LCO stream and the naphtha stream is rich in cyclic compounds such as naphthenes and aromatics.

Any of the above lines, conduits, units, devices, vessels, surrounding environments, zones, beds or similar may be equipped with one or more monitoring components including sensors, measurement devices, data capture devices or data transmission devices. Signals, process or status measurements, and data from monitoring components may be used to monitor conditions in, around, and on process equipment. Signals, measurements, and/or data generated or recorded by monitoring components may be collected, processed, and/or transmitted through one or more networks or connections that may be private or public, general or specific, direct or indirect, wired or wireless, encrypted or not encrypted, and/or combination(s) thereof; the specification is not intended to be limiting in this respect. Further, the figure shows one or more exemplary sensors such as 31, 33, and 35 located on one or more conduits. Nevertheless, there may be sensors present on every stream so that the corresponding parameter(s) can be controlled accordingly Signals, measurements, and/or data generated or recorded by monitoring components may be transmitted to one or more computing devices or systems. Computing devices or systems may include at least one processor and memory storing computer-readable instructions that, when executed by the at least one processor, cause the one or more computing devices to perform a process that may include one or more steps. For example, the one or more computing devices may be configured to receive, from one or more monitoring component, data related to at least one piece of equipment associated with the process. The one or more computing devices or systems may be configured to analyze the data. Based on analyzing the data, the one or more computing devices or systems may be configured to determine one or more recommended adjustments to one or more parameters of one or more processes described herein. The one or more computing devices or systems may be configured to transmit encrypted or unencrypted data that includes the one or more recommended adjustments to the one or more parameters of the one or more processes described herein.

Examples

Experiments were performed to study co-processing of naphtha feed with LCO stream in LCO hydrocracking process. A test was conducted comparing a Phase-1 feed comprising only LCO and a Phase-2 feed comprising LCO and naphtha having a characterization as shown in Table 1. Table 1 shows feed characterization such as specific gravity with respect to water, API gravity, sulfur content using X-ray Fluorescence (XRF), diene value of the feed, and ring content. Phase -2 feed comprises 50-50 wt % blend of LCO and naphtha. The pilot plant was operating under conditions as shown in Table 2. The results of the experiments are shown in Table 3.

TABLE 1

| Feed | Units | Phase-1 Feed | Phase-2 Feed |
|---|---|---|---|
| Sp. Gravity @ 60° F. | | 0.97 | 0.90 |
| API gravity | ° | 14.3 | 27.3 |
| Sulfur by XRF | wt-ppm | 3385 | 2908 |
| Nitrogen | wt-ppm | 768 | 358 |
| Hydrogen | wt % | 9 | 10.6 |
| Water Content | wt-ppm | | |
| Bromine Number | g Br/100 g | 11 | 26.4 |
| Diene Value | | 1.6 | 1.1 |
| Ring 1 | wt % | 21 | 34 |
| Ring 2 | wt % | 54 | 27 |
| Multiple Rings | wt % | 6.5 | 3.5 |

TABLE 2

| Phase | Plant Pressure Kg/cm$^2$g | Overall Fresh Feed LHSV 1/hr | Gas to Oil w.r.t. LCO SCMB | Target Net Conversion (Temperature) % (° C.) |
|---|---|---|---|---|
| Phase-1 | 75 | 0.85 | 396.44 | ~55 (365)<br>~70 (370) |
| Phase-2 | 75 | 1.7 | 396.44 | ~55 (370)<br>~70 (375) |

TABLE 3

| | Units | Phase-1 | Phase-2 |
|---|---|---|---|
| Gross Conversion | wt % | 55.4 | 73.4 |
| Net Conversion | wt % | 53.6 | 54 |
| $H_2$ consumption | wt % | 4.1 | 2.5 |
| Yield 85-193° C. | wt % | 42 | 63.5 |
| Selectivity, 85-193° C. (Gross conversion basis) | wt % | 74.5 | 86.6 |
| Product Sulfur | wt ppm | 3.0 | 1.1 |
| Product Nitrogen | wt ppm | 0.17 | 0.09 |

Figure 4:
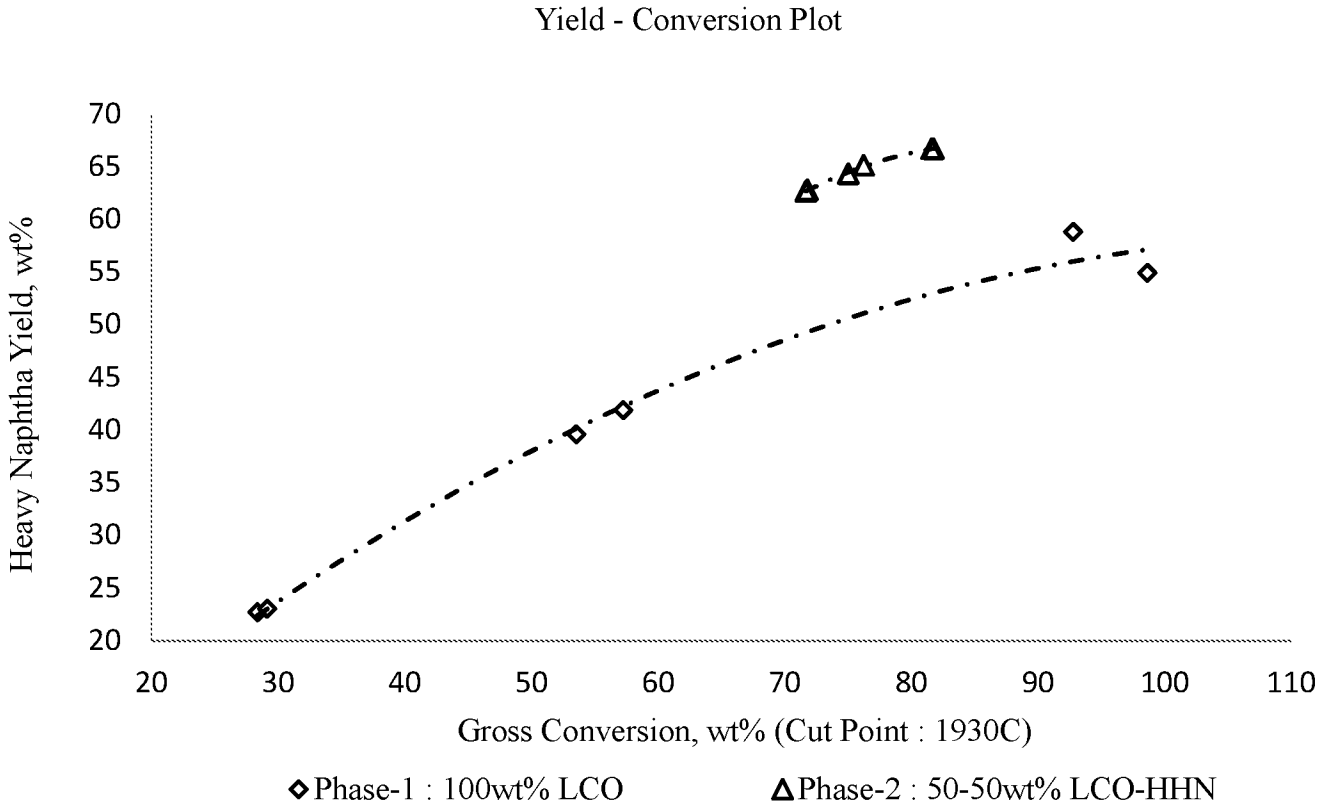
FIG. 4 is a graph showing heavy naphtha yield relative to net conversion.
Figure 5:
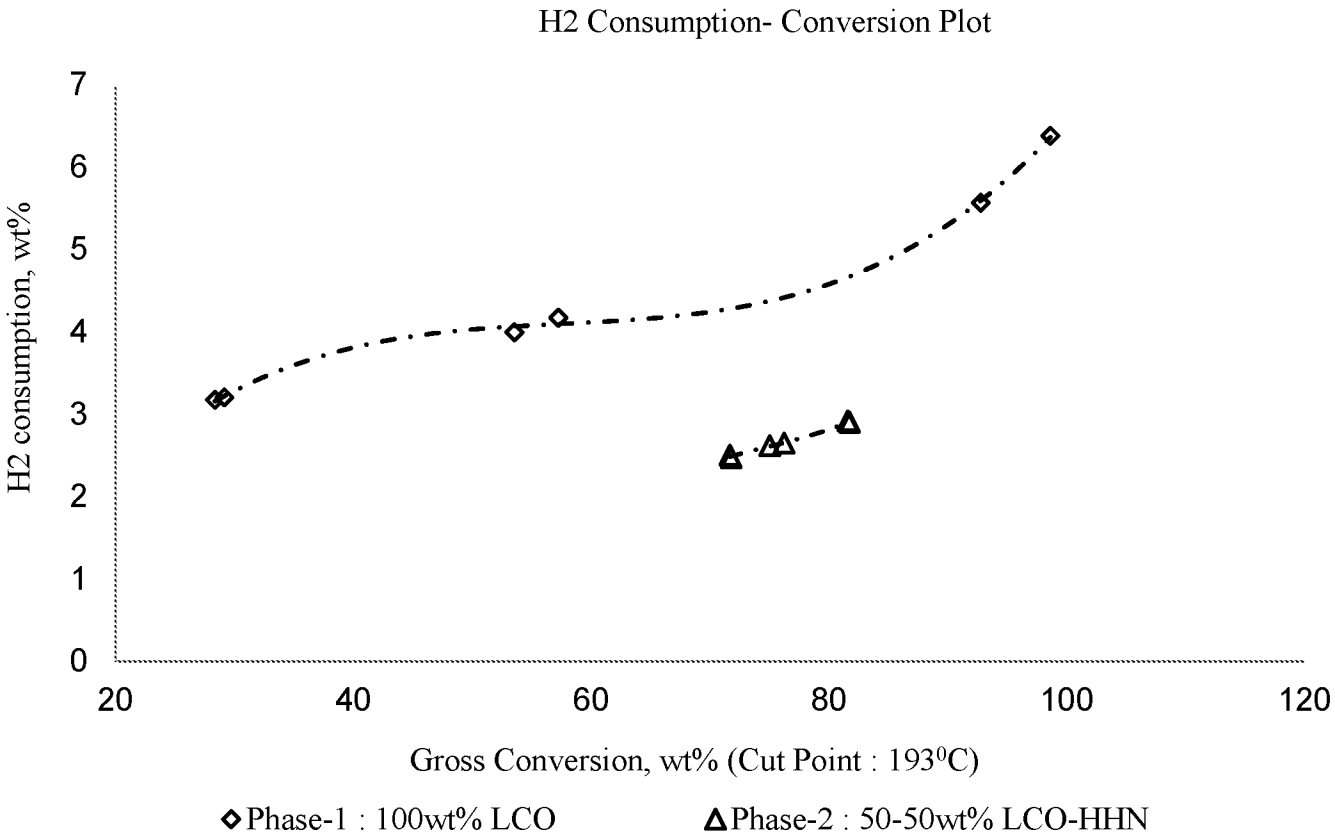
FIG. 5 is a graph showing hydrogen consumption relative to net conversion.

FIG. 4 depicts heavy naphtha yield relative to gross conversion. FIG. 5 depicts hydrogen consumption relative to net conversion. From the data as shown in Table 3, it is observed that Phase-2 feed comprising 50-50 wt % of LCO and naphtha results in higher heavy naphtha yield as compared to Phase-1 feed comprising only LCO. Further, the hydrogen consumption of Phase -2 feed is lower than for the Phase-1 feed. The Phase-2 feed is more selective towards desired heavy naphtha product. Moreover, sulfur and nitrogen contaminants in the product is less concentrated when Phase-2 feed is used.

Heavy naphtha obtained as product has composition as shown in Table 4. The analysis was done on PIONA basis. As per Table 4, using Phase-2 feed results in heavy naphtha with higher N+2A multiplier. The heavy naphtha produced in this co-processing approach has high ring compounds.

TABLE 4

| | | Heavy Naphtha Cut, 85-193° C. | |
|---|---|---|---|
| Distillation by D2887 | Units | Phase-1 | Phase-2 |
| IBP/5 | ° C. | 25.6/91 | 76/102 |
| 10/30 | ° C. | 102/118 | 113.6/141 |
| 50/70 | ° C. | 141/163 | 152/168 |
| 90/95 | ° C. | 184/190 | 185/190 |
| FBP | ° C. | 205 | 202.6 |
| Yield, 85-193° C. | wt % | 41.76 | 63.54 |
| Paraffins | wt % | 1.5 | 5.4 |
| Iso-paraffins | wt % | 12.5 | 21.0 |

TABLE 4-continued

| Distillation by D2887 | Units | Heavy Naphtha Cut, 85-193° C. Phase-1 | Phase-2 |
|---|---|---|---|
| Olefins | wt % | 0.08 | 0.12 |
| Naphthenes | wt % | 39.2 | 27.6 |
| Aromatics | wt % | 45.6 | 45.3 |
| N + 2A | wt % | 130 | 118 |
| (N + 2A)*Yield (multiplier) | Octane Barrels | 5429 | 7498 |
| API | ° | 42.4 | 44 |
| Specific gravity | g/cc | 0.8 | 0.81 |
| Total Sulfur | wt ppm | 2.1 | 0.42 |

A comparison of total cyclics; i.e, naphthenes and aromatics (N+A) in the product obtained using Phase-1 and Phase-2 feed at 55% conversion is shown in Table 5. The theoretical value of total cyclics in the product obtained from hydroprocessing of Phase-2 feed comprising a blend of 50 wt % LCO and 50 wt % naphtha is considered to be the sum of the total cyclics present in the naphtha feed and the total cyclics present in the product obtained from hydroprocessing of Phase-1 feed comprising 100 wt % LCO. However, the experimental values differ from the theoretical values. Table 5 shows that the experimental value of total cyclics present in product obtained from Phase-2 feed is much higher than that of product obtained from Phase-1 feed.

TABLE 5

| | Units | Product obtained from Phase-1 feed | Phase-2 feed | Product obtained from Phase-2 feed | Product obtained from Phase-2 feed |
|---|---|---|---|---|---|
| Mode | | Experimental | Theoretical | Theoretical | Experimental |
| Net conversion, (Cut Point 193° C.) | wt % | 55 | 0 | 55 | 55 |
| LCO Feed | kg/hr | 20000 | 20000 | 20000 | 20000 |
| Heavy FCC Naphtha Feed | kg/hr | 0 | 20000 | 20000 | 20000 |
| Total Feed Rate | kg/hr | 20000 | 40000 | 40000 | 40000 |
| Naphtha (85-193° C.) | wt % | 0 | 43 | 43 | 43 |
| Total Heavy Naphtha (85-193° C. BP) | kg/hr | 8400 | 17200 | 25600 | 25400 |
| Total Naphthenes (N) (85-193° C. BP) | kg/hr | 3289.4 | 1380 | 4669.4 | 7010.4 |
| Total Aromatics (A) (85-193° C. BP) | kg/hr | 3810.2 | 10,380 | 14190.2 | 11509 |
| Total Cyclics (N + A) (85-193° C. BP) | kg/hr | 7099.6 | 11760 | 18859.6 | 18667.6 |

It was surprising that the Phase-2 feed produced almost as much total cyclics as theoretical. It would have been expected that the paraffinic naphtha would crack to LPG, naphthenic naphtha would crack to aliphatics and LPG and aromatic naphtha would hydrogenate to naphthenes and perhaps crack to aliphatics and LPG. Production of such high proportion of cyclics yields an optimal feedstock for aromatic petrochemical production.

Although the invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

Specific Embodiments

While the following is described in conjunction with specific embodiments, it will be understood that this description is intended to illustrate and not limit the scope of the preceding description and the appended claims.

A first embodiment of the invention is a process for co-processing a naphtha stream and a light cycle oil stream comprising hydrocracking the light cycle oil stream under hydrocracking conditions to provide a hydrocracked effluent stream; hydrotreating the naphtha stream under hydrotreating conditions to provide a hydrotreated effluent stream; passing the hydrocracked effluent stream and the hydrotreated effluent stream to a stripping column to recover a stripping bottom stream; and passing the stripping bottom stream to a main fractionation column to recover an intermediate naphtha stream. An embodiment of the invention is one, any or all of prior embodiments in this paragraph up through the first embodiment in this paragraph further comprising selectively hydrotreating the naphtha stream in a diolefin saturation reactor before hydrotreating the naphtha stream. An embodiment of the invention is one, any or all of prior embodiments in this paragraph up through the first embodiment in this paragraph, wherein the step of hydrotreating the naphtha stream takes place in a post-treatment bed after the hydrocracking step. An embodiment of the invention is one, any or all of prior embodiments in this paragraph up through the first embodiment in this paragraph further comprising recovering a stripping column overhead stream comprising $C_4$ and lighter hydrocarbons. An embodiment of the invention is one, any or all of prior embodiments in this paragraph up through the first embodiment in this paragraph further comprising processing the intermediate naphtha stream to recover aromatics. An embodiment of the invention is one, any or all of prior embodiments in this paragraph up through the first embodiment in this paragraph, wherein processing the intermediate naphtha stream comprises passing the intermediate naphtha stream to a dehydrogenation reactor to recover a dehydrogenated stream. An embodiment of the invention is one, any or all of prior embodiments in this paragraph up through the first embodiment in this paragraph further comprising passing the dehydrogenated stream to a separator to recover a hydrogen-rich stream and an aromatics-rich stream. An embodiment of the invention is one, any or all of prior embodiments in this paragraph up through the first embodiment in this paragraph further comprising recovering a gasoline stream and an ultra-low sulfur diesel stream from the main fractionation column. An embodiment of the invention is one, any or all of prior embodiments in this paragraph up through the first embodiment in this paragraph further comprising recovering benzene, toluene, and xylene from the aromatics-rich stream and the gasoline stream. An embodiment of the invention is one, any or all of prior embodiments in this paragraph up through the first embodiment in this paragraph further comprising at least one of sensing at least one parameter of the process and generating a signal or data from the sensing; generating and transmitting a signal; or generating and transmitting data.

A second embodiment of the invention is a process for co-processing a naphtha stream and a light cycle oil stream comprising hydrotreating the naphtha stream and the light cycle oil stream under hydrotreating conditions to provide a hydrotreated effluent stream; hydrocracking the hydrotreated effluent stream under hydrocracking conditions to provide a hydrocracked effluent stream; passing the hydrocracked effluent stream to a stripping column to recover a stripping bottom stream; passing the stripping bottom stream to a main fractionation column to recover an intermediate naphtha stream; and recovering aromatics from the intermediate naphtha stream. An embodiment of the invention is one, any or all of prior embodiments in this paragraph up through the second embodiment in this paragraph further comprising selectively hydrotreating the naphtha stream in a diolefin saturation reactor before hydrotreating the naphtha stream. An embodiment of the invention is one, any or all of prior embodiments in this paragraph up through the second embodiment in this paragraph further comprising hydrotreating the hydrocracked effluent stream in a post-treatment bed before passing the hydrocracked effluent stream to a stripping column to remove sulfur and nitrogen therefrom. An embodiment of the invention is one, any or all of prior embodiments in this paragraph up through the second embodiment in this paragraph, wherein recovering aromatics from the intermediate naphtha stream comprises passing the intermediate naphtha stream to a dehydrogenation reactor to recover a dehydrogenated stream. An embodiment of the invention is one, any or all of prior embodiments in this paragraph up through the second embodiment in this paragraph further comprising passing the dehydrogenated stream to a separator to recover a hydrogen-rich stream and an aromatics-rich stream. An embodiment of the invention is one, any or all of prior embodiments in this paragraph up through the second embodiment in this paragraph further comprising recovering a gasoline stream and an ultra-low sulfur diesel stream from the main fractionation column. An embodiment of the invention is one, any or all of prior embodiments in this paragraph up through the second embodiment in this paragraph further comprising recovering benzene, toluene, and xylene from the aromatics-rich stream and the gasoline stream.

A third embodiment of the invention is a process for co-processing a naphtha stream and a light cycle oil stream comprising hydrotreating the light cycle oil stream under hydrotreating conditions to provide a hydrotreated effluent stream; hydrocracking the naphtha stream and the hydrotreated effluent stream under hydrocracking conditions to provide a hydrocracked effluent stream; passing the hydrocracked effluent stream to a main fractionation column to recover a gasoline stream, an intermediate naphtha stream and an ultra-low sulfur diesel stream; passing the intermediate naphtha stream to a dehydrogenation reactor to produce a dehydrogenated stream; and recovering aromatics from the dehydrogenated stream. An embodiment of the invention is one, any or all of prior embodiments in this paragraph up through the third embodiment in this paragraph further comprising hydrotreating the hydrocracked effluent stream in a post-treatment bed before passing the hydrocracked effluent stream to the main fractionation column. An embodiment of the invention is one, any or all of prior embodiments in this paragraph up through the third embodiment in this paragraph wherein recovering aromatics from the dehydrogenated stream comprises passing the dehydrogenated stream to a separator to recover a hydrogen-rich stream and an aromatics-rich stream; and recovering benzene, toluene, and xylene from the aromatics-rich stream and the gasoline stream.

Without further elaboration, it is believed that using the preceding description that one skilled in the art can utilize the present invention to its fullest extent and easily ascertain the essential characteristics of this invention, without departing from the spirit and scope thereof, to make various changes and modifications of the invention and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

In the foregoing, all temperatures are set forth in degrees Celsius and, all parts and percentages are by weight, unless otherwise indicated.

The invention claimed is:

1. A process for co-processing a naphtha stream and a light cycle oil stream comprising:

hydrocracking the light cycle oil stream in a hydrocracking catalyst bed under hydrocracking conditions to provide a hydrocracked effluent stream;

hydrotreating the naphtha stream and the hydrocracked effluent stream in a hydrotreating catalyst bed under hydrotreating conditions to provide a hydrotreated effluent stream;

passing the hydrotreated effluent stream to a stripping column to recover a stripped bottom stream; and passing the stripped bottom stream to a main fractionation column to recover an intermediate naphtha stream.

2. The process of claim 1 further comprising selectively hydrotreating the naphtha stream in a diolefin saturation reactor before hydrotreating the naphtha stream.

3. The process of claim 1, wherein the step of hydrotreating the naphtha stream takes place in a post-treatment bed downstream of the hydrocracking bed.

4. The process of claim 1 further comprising recovering a stripping column overhead stream comprising C4 and lighter hydrocarbons.

5. The process of claim 1 further comprising processing the intermediate naphtha stream to recover aromatics.

6. The process of claim 5, wherein processing the intermediate naphtha stream comprises passing the intermediate naphtha stream to a dehydrogenation reactor to recover a dehydrogenated stream.

7. The process of claim 6 further comprising passing the dehydrogenated stream to a separator to recover a hydrogen-rich stream and an aromatics-rich stream.

8. The process of claim 7 further comprising recovering a gasoline stream and an ultra-low sulfur diesel stream from the main fractionation column.

9. The process of claim 8 further comprising recovering benzene, toluene, and xylene from the aromatics-rich stream and the gasoline stream.

* * * * *